US010971133B2

(12) United States Patent
Yang

(10) Patent No.: US 10,971,133 B2
(45) Date of Patent: Apr. 6, 2021

(54) VOICE SYNTHESIS METHOD, DEVICE AND APPARATUS, AS WELL AS NON-VOLATILE STORAGE MEDIUM

(71) Applicant: Baidu Online Network Technology (Beijing) Co., Ltd, Beijing (CN)

(72) Inventor: Jie Yang, Beijing (CN)

(73) Assignee: Baidu Online Network Technology (Beijing) Co., Ltd, Beijing (CN)

( * ) Notice: Subject to any disclaimer, the term of this patent is extended or adjusted under 35 U.S.C. 154(b) by 50 days.

(21) Appl. No.: 16/546,893

(22) Filed: Aug. 21, 2019

(65) Prior Publication Data

US 2020/0193962 A1 Jun. 18, 2020

(30) Foreign Application Priority Data

Dec. 13, 2018 (CN) ..... 201811523539.X

(51) Int. Cl.
*G10L 13/00* (2006.01)
*G10L 13/033* (2013.01)

(52) U.S. Cl.
CPC ..... *G10L 13/033* (2013.01)

(58) Field of Classification Search
CPC ..... G10L 13/033
See application file for complete search history.

(56) References Cited

U.S. PATENT DOCUMENTS

2017/0076714 A1* 3/2017 Mori ..... G10L 13/033
2017/0092259 A1* 3/2017 Jeon ..... G10L 13/07

FOREIGN PATENT DOCUMENTS

CN 104485100 A 4/2015
CN 108536655 A 9/2018

* cited by examiner

*Primary Examiner* — Ibrahim Siddo
(74) *Attorney, Agent, or Firm* — Akerman LLP

(57) ABSTRACT

A voice synthesis method is provided. The method includes: for each sound model of a plurality of sound models, performing a first matching operation on a user attribute and a sound model attribute of the sound model to obtain a first matching degree for the sound model attribute, and determining a sound model with a sound model attribute having the highest first matching degree as a recommended sound model; for each content of a plurality of contents, performing a second matching operation on a sound model attribute of the recommended sound model and a content attribute of the content to obtain a second matching degree for the content attribute, and determining a content with a content attribute having the highest second matching degree as a recommended content; and performing a voice synthesis on the recommended content by using the recommended sound model, to obtain a synthesized voice file.

9 Claims, 6 Drawing Sheets

VOICE SYNTHESIS METHOD, DEVICE AND APPARATUS, AS WELL AS NON-VOLATILE STORAGE MEDIUM

CROSS-REFERENCE TO RELATED APPLICATION

This application claims priority to Chinese Patent Application No. 201811523539.X entitled "Voice Synthesis Method, Device and Apparatus, as well as Non-Volatile Storage Medium", and filed on Dec. 13, 2018, which is hereby incorporated by reference in its entirety.

TECHNICAL FIELD

The present application relates to a technical field of voice synthesis technology, and in particular, to a voice synthesis method, device, apparatus, and a non-volatile storage medium.

BACKGROUND

Voice synthesis technology is one of important technologies and application directions in the field of artificial intelligent voice. By means of the voice synthesis technology, texts input by users or products can be converted into voice, and anthropomorphic voice can be output by imitating human "talking" through a machine. The voice synthesis technology can be applied in several scenarios, such as mobile applications, Internet applications, applet applications, and Internet of Things (IoT) intelligent hardware devices, and the like, and is one of main ways for people to interact with machines naturally.

Current voice synthesis systems can provide users with a variety of sound models, and various sound models can correspond to different tone features, accent features and the like. The users can select a suitable sound model and use the sound model to perform voice synthesis on the text to obtain a corresponding voice text by themselves. By this way, only a scenario in which a user performs selection actively is taken into account. However, no sound model is recommend based on user preferences or user attributes, and whether the recommended sound model is appropriate for the content is not taken into account as well. For example, a sound model for a deep and heavy tone may be not suitable for funny content, and a sound model for British English may be not suitable for an American drama, etc. Since it is difficult to ensure that a sound model is synthesized by applying a suitable match, a better user experience cannot be provided by means of existing voice synthesis systems.

SUMMARY

A voice synthesis method and device are provided according to embodiments, so as to at least solve the above technical problems in existing technologies.

In embodiments, a voice synthesis method is provided, the method including:

for each sound model of a plurality of sound models, performing a first matching operation on a user attribute and a sound model attribute of the sound model to obtain a first matching degree for the sound model attribute, and determining a sound model with a sound model attribute having the highest first matching degree as a recommended sound model;

for each content of a plurality of contents, performing a second matching operation on a sound model attribute of the recommended sound model and a content attribute of the content to obtain a second matching degree for the content attribute, and determining a content with a content attribute having the highest second matching degree as a recommended content; and performing a voice synthesis on the recommended content by using the recommended sound model, to obtain a synthesized voice file.

In embodiments, prior to the performing the first matching operation, the method further includes:

setting a user attribute for a user, respective sound model attributes for the plurality of sound models, and respective content attributes for the plurality of contents; wherein the user attribute includes at least one user tag, and a weight for the user tag;

each sound model attribute includes at least one sound model tag, and a weight for the sound model tag; and each content attribute includes at least one content tag, and a weight for the content tag.

In embodiments, the first matching operation includes:

selecting a sound model tag of the sound model attribute, according to a user tag of the user attribute;

calculating a relevance degree between the user tag and the sound model tag, according to a weight of the user tag and a weight of the sound model tag; and determining the first matching degree between the user attribute and the sound model attribute, according to the relevance degree between the user tag and the sound model tag.

In embodiments, the second matching operation includes:

selecting a content tag of the content attribute, according to a sound model tag of the sound model attribute;

calculating a relevance degree between the sound model tag and the content tag, according to a weight of the sound model tag and a weight of the content tag; and determining the second matching degree between the sound model attribute and the content attribute, according to the relevance degree between the sound model tag and the content tag.

In embodiments, a voice synthesis device is provided, the apparatus including:

a sound recommending module configured to, for each sound model of a plurality of sound models, perform a first matching operation on a user attribute and a sound model attribute of the sound model to obtain a first matching degree for the sound model attribute, and determine a sound model with a sound model attribute having the highest first matching degree as a recommended sound model;

a content recommending module configured to, for each content of a plurality of contents, perform a second matching operation on a sound model attribute of the recommended sound model and a content attribute of the content to obtain a second matching degree for the content attribute, and determine a content with a content attribute having the highest second matching degree as a recommended content; and a synthesizing module configured to perform a voice synthesis on the recommended content by using the recommended sound model, to obtain a synthesized voice file.

In embodiments, the device further includes:

an attribute setting module configured to set a user attribute for a user, respective sound model attributes for the plurality of sound models, and respective content attributes for the plurality of contents; wherein the user attribute includes at least one user tag, and a weight for the user tag; each sound model attribute includes at least one sound model tag, and a weight for the sound model tag; and each content attribute includes at least one content tag, and a weight for the content tag.

In embodiments, the sound recommending module includes:

a first selecting sub-module, configured to select a sound model tag of the sound model attribute, according to a user tag of the user attribute;

a first calculating sub-module, configured to calculate a relevance degree between the user tag and the sound model tag, according to a weight of the user tag and a weight of the sound model tag; and a first matching sub-module, configured to determine the first matching degree between the user attribute and the sound model attribute, according to the relevance degree between the user tag and the sound model tag.

In embodiments, the content recommending module includes:

a second selecting sub-module, configured to select a content tag of the content attribute, according to a sound model tag of the sound model attribute;

a second calculating sub-module, configured to calculate a relevance degree between the sound model tag and the content tag, according to a weight of the sound model tag and a weight of the content tag; and a second matching sub-module, configured to determine the second matching degree between the sound model attribute and the content attribute, according to the relevance degree between the sound model tag and the content tag.

In embodiments, a voice synthesis apparatus is provided. The functions of the apparatus may be implemented by using hardware or by executing corresponding software with hardware. The hardware or software includes one or more modules corresponding to the functions described above.

In an embodiment, the voice synthesis apparatus structurally includes a processor and a memory, wherein the memory is configured to store programs which support the apparatus to execute the above voice synthesis method. The processor is configured to execute the programs stored in the memory. The voice synthesis apparatus may further include communication interfaces through which the apparatus is communicated with other devices or communication networks.

In embodiments, a non-volatile computer readable storage medium for storing computer software instructions used for a voice synthesis device is provided, the non-volatile computer readable storage medium including programs involved in executing the above voice synthesis method.

One of the above technical solutions has the following advantages or beneficial effects.

With the voice synthesis method and device according to the embodiments, a suitable sound model for a user is recommended, a content suitable for the sound model is further recommended, and then voice synthesis on the recommended content is performed by using the recommended sound model. Since an effect of a voice synthesis finally obtained is determined by using a sound model recommended based on a user attribute, and by using the content recommended based on the sound model, it is possible to recommend a suitable voice and suitable content to be synthesized based on the user attribute, so that the synthesized voice file can better utilize the advantages of each sound model, thereby improving the user experience.

The above summary is for the purpose of the specification only and is not intended to be limiting in any way. In addition to the illustrative aspects, embodiments, and features described above, further aspects, embodiments, and features of the present application will be readily understood by reference to the drawings and the following detailed description.

BRIEF DESCRIPTION OF THE DRAWINGS

In the drawings, unless otherwise specified, identical or similar parts or elements are denoted by identical reference signs throughout several figures of the accompanying drawings. The drawings are not necessarily drawn to scale. It should be understood that these drawings merely illustrate some embodiments, and should not be construed as limiting the scope of the application.

DETAILED DESCRIPTION OF THE EMBODIMENT(S)

In the following, only certain exemplary embodiments are briefly described. As those skilled in the art would realize, the described embodiments may be modified in various different ways, all without departing from the spirit or scope of the present application. Accordingly, the drawings and description are to be regarded as illustrative in nature and not restrictive.

According to embodiments of the present application, a voice synthesis method and apparatus are provided. Hereafter, detailed description is made with respect to the technical solutions by way of the following embodiments.

Figure 1:
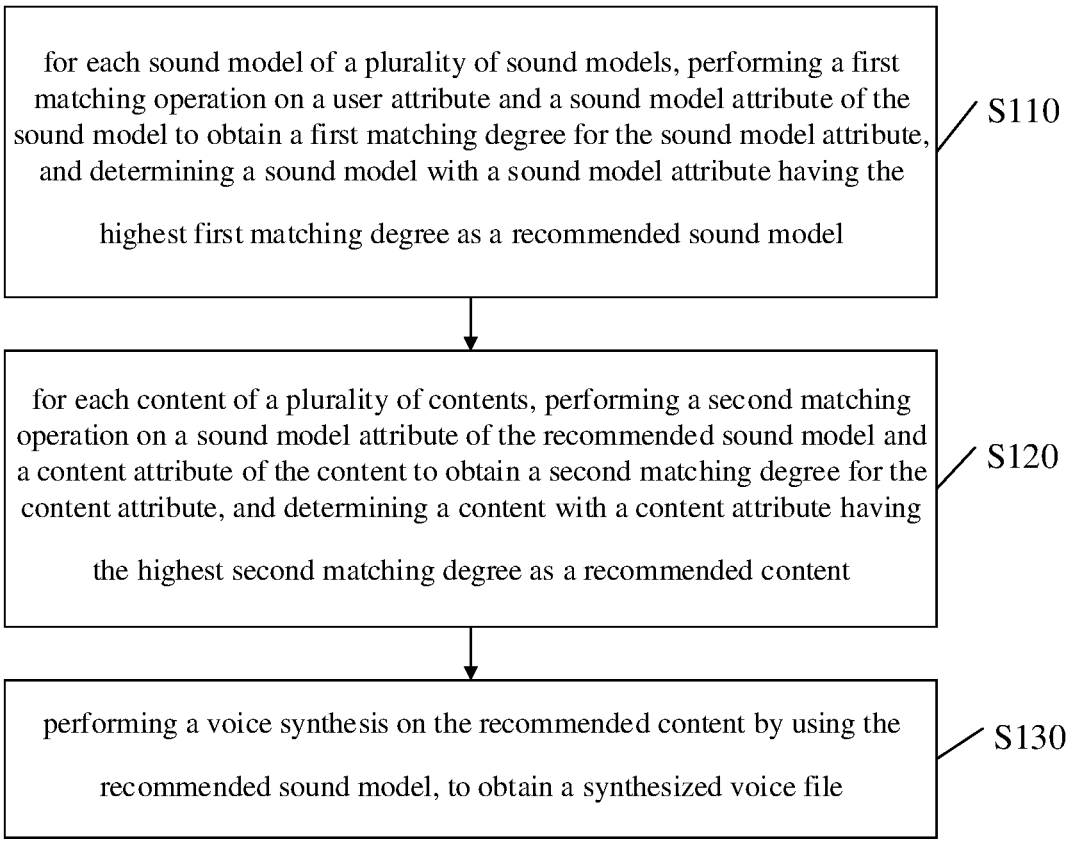
FIG. 1 is a flowchart of implementing a voice synthesis method, according to an embodiment.

FIG. 1 is a flowchart of a voice synthesis method, according to an embodiment of the present application, and the voice synthesis method includes S110-S130.

At S110, for each sound model of a plurality of sound models, a first matching operation is performed on a user attribute and a sound model attribute of the sound model to obtain a first matching degree for the sound model attribute, and a sound model with a sound model attribute having the highest first matching degree is determined as a recommended sound model.

At S120, for each content of a plurality of contents, a second matching operation is performed on a sound model attribute of the recommended sound model and a content attribute of the content to obtain a second matching degree for the content attribute, and a content with a content attribute having the highest second matching degree is determined as a recommended content.

At S130, a voice synthesis is performed on the recommended content by using the recommended sound model, to obtain a synthesized voice file.

The embodiments of the present application can be applied to mobile applications, Internet applications, applet applications, Internet of Things (IoT) intelligent hardware devices, and the like, such as audio reading applications, news websites, radio programs, smart speakers, etc., to provide users with voice files.

The term "content" in the embodiments of the present application may include text information from various sources, such as articles from official accounts, contents of We-media products, news information, User Generated Contents (UGCs), Professional Generated Contents (PGCs). In addition to a content in the form of text, the content used by the embodiments of the present application may also be in other content forms. When a content in the non-text form is used, according to an embodiment of the present application, the content may be converted into a text firstly, and then voice synthesis may be performed on the converted text.

Figure 2:
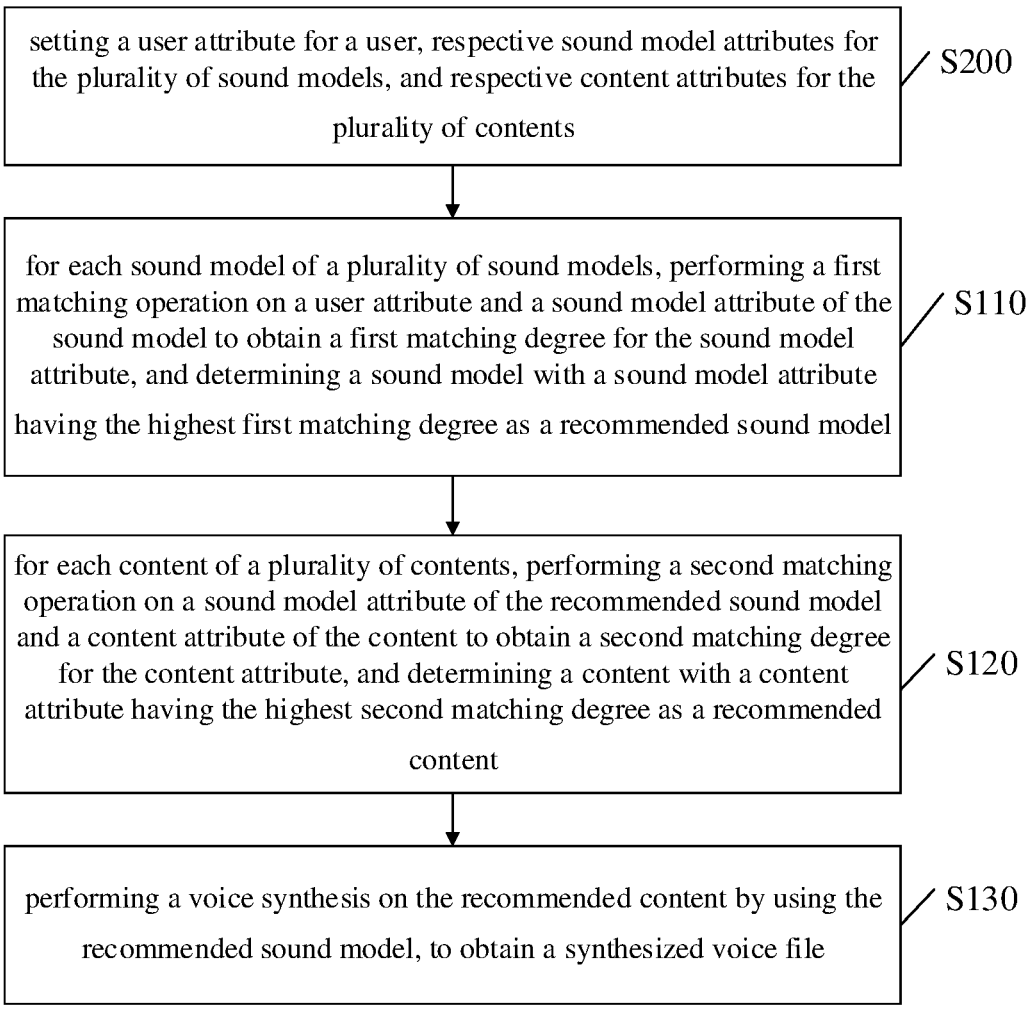
FIG. 2 is a flowchart of implementing another voice synthesis method, according to an embodiment.

FIG. 2 is a flowchart of another voice synthesis method according to an embodiment, and the voice synthesis method further includes S200 compared with the voice synthesis method in FIG. 1.

At S200, a user attribute for a user is set, respective sound model attributes for the plurality of sound models are set, and respective content attributes for the plurality of contents are set;

where the user attribute includes at least one user tag, and a weight for the user tag;

each sound model attribute includes at least one sound model tag, and a weight for the sound model tag; and each content attribute includes at least one content tag, and a weight for the content tag.

At S110, for each sound model of a plurality of sound models, a first matching operation is performed on a user attribute and a sound model attribute of the sound model to obtain a first matching degree for the sound model attribute, and a sound model with a sound model attribute having the highest first matching degree is determined as a recommended sound model.

At S120, for each content of a plurality of contents, a second matching operation is performed on a sound model attribute of the recommended sound model and a content attribute of the content to obtain a second matching degree for the content attribute, and a content with a content attribute having the highest second matching degree is determined as a recommended content.

At S130, a voice synthesis is performed on the recommended content by using the recommended sound model, to obtain a synthesized voice file.

Specific examples of a user attribute, a sound model attribute, and a content attribute are described below according to specific embodiments.

When a user attribute is set, user information can be obtained from, for example, an application server and the like, which provide services for the user, and the user attribute is then set according to the obtained user information.

The user attribute may include more than one user tag, and respective weights for the more than one user tag. The user tag is used to identify a natural attribute, social attribute, location attribute, interest attribute of the user, and so on. A user tag may be set with a respective level. The higher the level of the user tag is, the more detailed the attribute including the user tag is. For example, "Language competence—Chinese" can be used as a first-level tag, and "Language competence—Cantonese" can be used as a second-level tag.

Each user tag is assigned a weight, and a range of the weight can be set as [0, 100]. The greater the weight is, the more the user tag is consistent with the actual situation of the user. For example, the weight of a user tag for identifying the natural attribute represents a confidence level, while the weight of a user tag for identifying the interest attribute indicates an interest degree.

Table 1 shows examples of user tags of a user attribute.

TABLE 1

| category | first-level user tag | second-level user tag |
|---|---|---|
| natural attribute | male, female | |
| | 18 to 24 years old, 25 to 34 years old, etc. | |
| | sweet and lovely, young and energetic, low and thick, etc. | |
| social attribute | Chinese | Mandarin, Cantonese, etc. |
| | English | British English, American English, etc. |
| | single, married, unmarried, in-love, etc. | |
| location attribute | Beijing, Shanghai, etc. | |
| interest attribute | Business Finance and Economics | Business Finance and Economics, Investment and Financing, Economic Review |
| | news information | technology, internet, military, entertainment, etc. |
| | history humanities | poetry and songs, classics, artistic accomplishments, etc. |
| | radio stations | literary radio station, story radio station, emotional radio station, etc. |
| | style preferences | healing, disabusing, mentality, quietness, etc. |
| | emotional preferences | quietness, sweetness, loneliness, happiness, fun, etc. |

The sound model attribute can include one or more sound model tags, and respective weights for the one or more sound model tags. The sound model tag is used to identify a tone attribute, a linguistic/language attribute, a corpus attribute, a style attribute, an emotional attribute, a scenario attribute, and the like of a sound model.

The tone attribute includes a gender characteristic, an age characteristic, a tone style characteristic, being a star sound, and the like of the sound model.

The linguistic/language attribute includes a linguistic characteristic, and a language characteristic of the sound model.

The corpus attribute includes content suitable for the sound model.

The style attribute includes the style attributes suitable for the sound model.

The emotional attribute includes an emotion attribute suitable for the sound model.

The scenario attribute includes a scenario attribute suitable for the sound model.

A sound model tag can be set with a respective level. The higher the level of the tag is, the more detailed an attribute including the sound model tag is.

Each sound model tag is assigned a weight, and the range of the weight can be set as [0, 100]. The greater the weight is, the more the sound model tag is consistent with the actual situation of the sound model. For example, the weight of a sound model tag for identifying the emotional attribute, the scenario attribute, and the like represents a conformity degree, and the weight for identifying the corpus attribute represents the degree of recommendation of the sound model, that is, how much the sound model is recommended for synthesizing the content.

Table 2 shows examples of sound model tags for a sound model attribute.

TABLE 2

| category | first-level sound model tag | second-level sound model tag |
|---|---|---|
| tone attribute | male, female | |
| | 18 to 24 years old, 25 to 34 years old, etc. | |
| | sweet and lovely, young and energetic, low and thick, etc. | |
| linguistic/ language attribute | Chinese | Mandarin, Cantonese, etc. |
| | English | British English, American English, etc. |
| corpus attribute | news information | technology, internet, military, entertainment, etc. |
| | history humanities | poetry and songs, classics, artistic accomplishments, etc. |
| | radio stations | literary radio station, story radio station, emotional radio station, etc. |
| style attribute | sober, healing, rational, literary, romantic, etc. | |
| emotional attribute | quiet, sweet, lonely, sad, cheerful, etc. | |
| scenario attribute | before sleep, at night, during lunch break, at work, on the road, etc. | |

The content attribute may include one or more content tags, and respective weights for the one or more content tags. The content attribute is used to identify the characteristics and types of content. A content tag may be set with a respective level. The higher the level of the tag is, the more detailed a characteristic or type for the content tag is.

Each content tag is assigned a weight, and the range of the weight can be set as [0, 100]. The greater the weight is, the more the content tag is consistent with the actual situation of the content.

Table 3 shows examples of content tags for a content attribute.

TABLE 3

| first-level content tag | second-level content tag |
|---|---|
| Business Finance and Economics | Business Finance and Economics, Investment and Financing, Economic Review |
| news information | technology, internet, military, entertainment, etc. |
| history humanities | poetry and songs, classics, artistic accomplishments, etc. |
| Traditional Chinese Academy | ancient historiography, classic masterpiece, Buddhist minds, reading clubs, poetry and songs, etc. |
| fiction | romance, mystery, city, fantasy, martial arts, history, etc. |

Specific examples of user attributes, sound model tags, and content attributes are described above. User attributes, sound model tags, or content attributes can be constantly updated and improved. The more the tags are, the more accurate the recommendations for sound models and content are.

With the above attributes, the first matching operation described in S110 and the second matching operation described in S120 can be performed.

Figure 3:
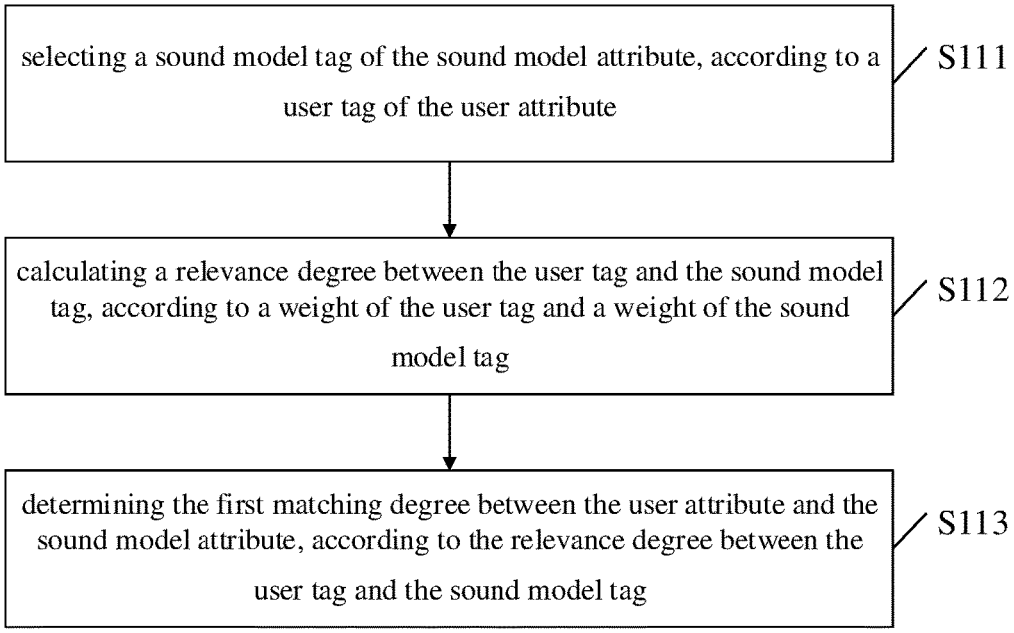
FIG. 3 is a flowchart of implementing a first matching operation in S110 of a voice synthesis method, according to an embodiment.

As shown in FIG. 3, in a possible implementation, at S110, the first matching operation includes:

S111, selecting a sound model tag of the sound model attribute, according to a user tag of the user attribute;

S112, calculating a relevance degree between the user tag and the sound model tag, according to a weight of the user tag and a weight of the sound model tag; and S113, determining the first matching degree between the user attribute and the sound model attribute, according to the relevance degree between the user tag and the sound model tag.

Figure 4:
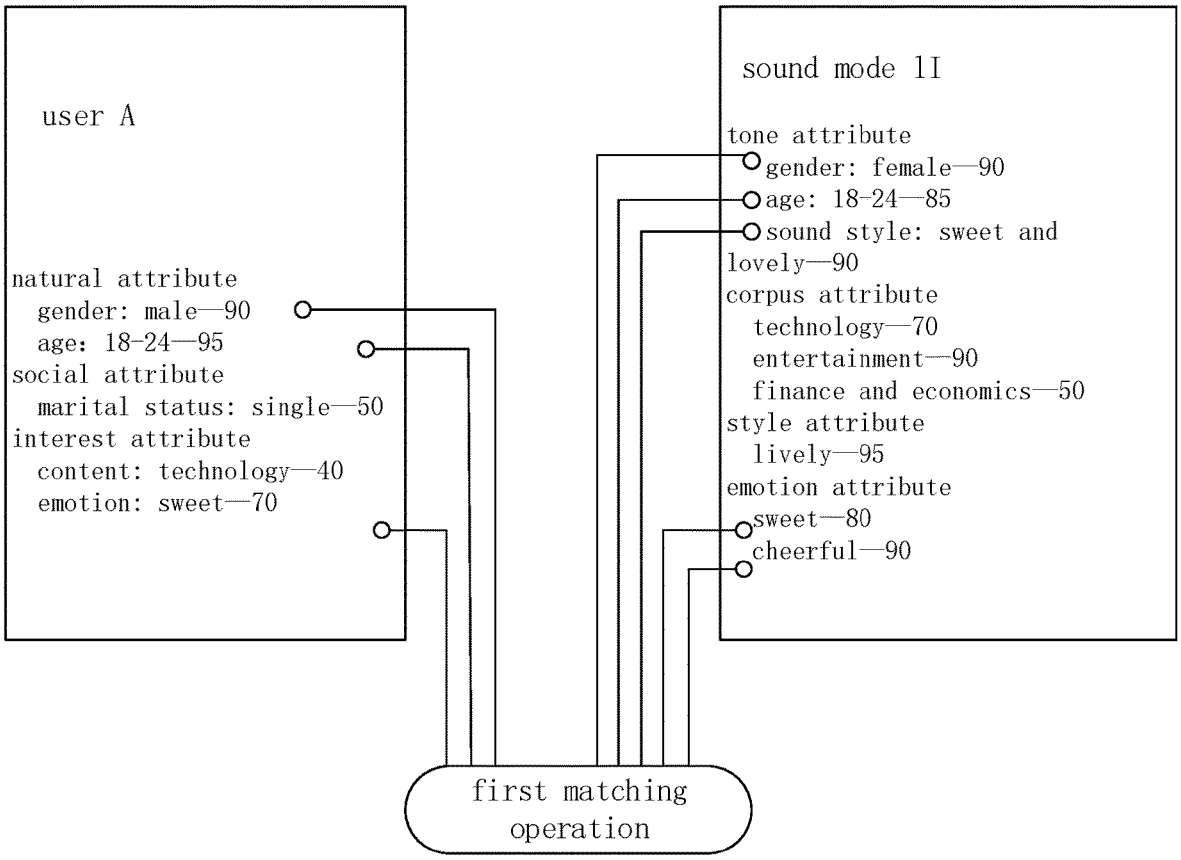
FIG. 4 is a schematic diagram of an implementation of performing a first matching operation on a user attribute of a user A and a sound model attribute of a sound model I.

FIG. 4 is a schematic diagram of an implementation of performing a first matching operation on a user attribute of a user A and a sound model attribute of a sound model I.

In FIG. 4, the user attribute of the user A includes user attribute tags identifying a natural attribute, a social attribute and an interest attribute, and respective weights for the user attribute tags.

TABLE 4

| category | user attribute tag | weight |
|---|---|---|
| natural attribute | gender: male | 90 |
| | age: 18 to 24 years old | 95 |
| social attribute | marital status: single | 50 |
| interest attribute | content preference: technology | 40 |
| | emotional preference: sweetness | 70 |

In FIG. 4, the sound model attribute of the sound model I includes sound model tags identifying a tone attribute, a corpus attribute, a style attribute or an emotional attribute, and respective weights of the sound model tags. As shown in table 5:

TABLE 5

| category | user attribute tag | weight |
|---|---|---|
| tone attribute | gender characteristics: female | 90 |
| | age characteristics: 18 to 24 years old | 85 |
| | sound style: sweet and lovely | 90 |
| corpus attribute | technology | 70 |
| | entertainment | 90 |
| | Business Finance and Economics | 50 |
| style attribute | fresh | 95 |
| emotional attribute | sweetness | 80 |
| | lively | 90 |

In the first matching operation, for each user tag for user A, a sound model tag is selected from the sound model attribute of the sound model I according to a user tag of the user attribute. Table 6 shows an example of the correspondence between a user tag and a sound model tag.

TABLE 6

| correspondence serial number | user tag of user A | weight | sound model tag of sound model I | Weight |
|---|---|---|---|---|
| 1 | gender: male | 90 | gender: female | 90 |
| 2 | age: 18 to 24 years old | 95 | age: 18 to 24 years old | 85 |
| 3 | interest attribute: sweetness | 70 | sound style: sweet and lovely | 90 |
| 4 | interest attribute: sweetness | 70 | emotional attribute: sweetness | 80 |
| 5 | interest attribute: sweetness | 70 | emotional attribute: lively | 90 |

As shown in Table 6, one user tag can correspond to multiple sound model tags, and vice versa.

After the correspondence is selected, for each correspondence, a relevance degree between a user tag and a sound model tag may be calculated according to a weight of the user tag and the weight of the sound model tag. A specific calculation formula can be determined according to actual situations. In principle, the greater the weight of the user tag or the weight of the sound model tag is, or the smaller the difference between the weight of the user tag and the weight of the sound model tag is, the higher the relevance degree between the user tag and the sound model tag is. The range of the value of relevance degree can be set as [0, 1]. The larger the value is, the higher the relevance degree is.

After that, the first matching degree of the user attribute and the sound model attribute can be determined with the relevance degree of each correspondence. For example, the relevance degree of all correspondences is averaged to obtain the first matching degree of the user attribute and the sound model attribute. The value range of the first matching degree can be set as [0, 1]. The larger the value is, the higher the first matching degree is.

The sound model for the sound model attribute with the highest first matching degree can be determined as the recommended sound model. If the user does not satisfy with the recommended sound model, the sound models for other sound model attributes with high first matching degrees may be sequentially recommended to the user.

After the recommended sound model is determined, the content of the content attribute having the highest second matching degree with the recommended sound model may be selected, and the content is recommended to the user, that is, S120 is performed.

Figure 5:
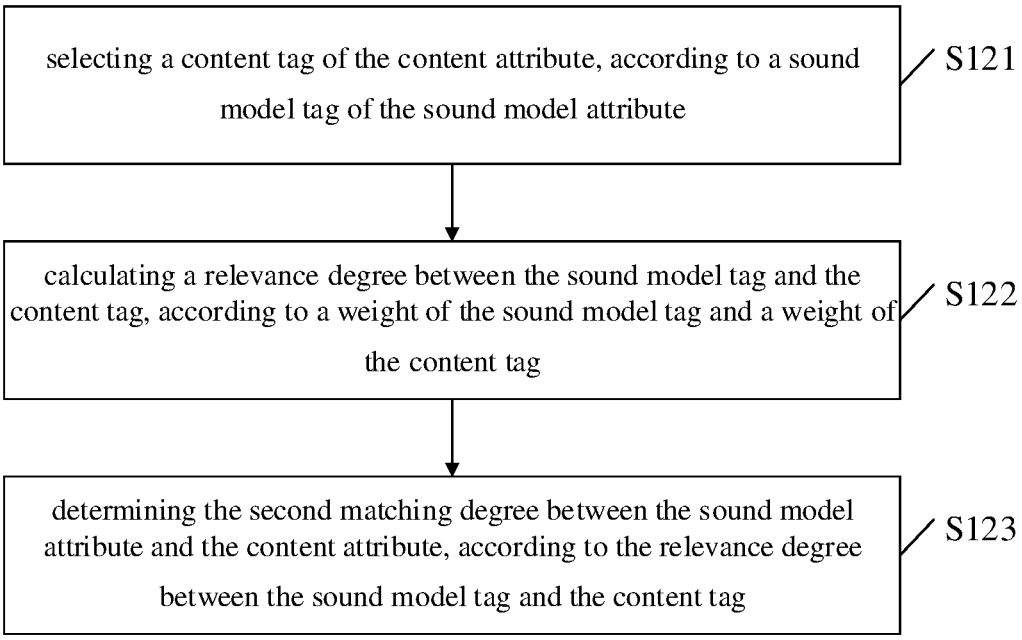
FIG. 5 is a flowchart of an implementing a second matching operation in S120 of a voice synthesis method, according to an embodiment.

As shown in FIG. 5, in a possible implementation, at S120, the second matching operation includes S121 to S123.

At S121, a content tag of the content attribute is selected according to a sound model tag of the sound model attribute.

At S122, a relevance degree between the sound model tag and the content tag is calculated according to a weight of the sound model tag and a weight of the content tag.

At S123, the second matching degree between the sound model attribute and the content attribute is determined according to the relevance degree between the sound model tag and the content tag.

In this embodiment, the specific manner of calculating the relevance degree between the sound model tag and the content tag of the sound model is similar to that of calculating the relevance degree between the user tag and the sound model tag in the above implementation. The specific manner of determining the second matching degree between the sound model attribute and the content attribute is similar to that of calculating the first matching degree between the user attribute and the sound model attribute in the above embodiment. Thus, they are not described here in detail again.

The content of the content attribute having the highest second matching degree can be determined as the recommended content. If a user does not satisfy with the recommended content, the content of other content attributes having high second matching degrees may be sequentially recommended to the user.

In a possible implementation, the recommended content may be synthesized with the above determined recommended sound model, and the parameters such as a volume, a pitch, a voice rate, and synthesized background music of the voice synthesis may be adjusted by default. Or, the text content inputted by a user may be synthesized with the above determined recommended sound model. Subsequently, the synthesized voice file can be sent to a corresponding application server, and the voice file is played to the user by the application server.

Figure 6:
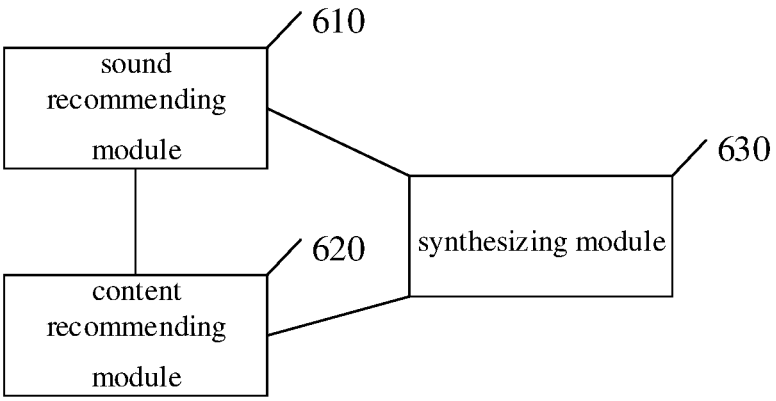
FIG. 6 is a schematic structural diagram of a voice synthesis device, according to an embodiment.

In embodiments, a voice synthesis device is further provided. Referring to FIG. 6, FIG. 6 is a schematic structural diagram of a voice synthesis device, according to an embodiment, the device including:

a sound recommending module 610, configured to, for each sound model of a plurality of sound models, perform a first matching operation on a user attribute and a sound model attribute of the sound model to obtain a first matching degree for the sound model attribute, and determine a sound model with a sound model attribute having the highest first matching degree as a recommended sound model;

a content recommending module 620, configured to, for each content of a plurality of contents, perform a second matching operation on a sound model attribute of the recommended sound model and a content attribute of the content to obtain a second matching degree for the content attribute, and determine a content with a content attribute having the highest second matching degree as a recommended content; and a synthesizing module 630, configured to perform a voice synthesis on the recommended content by using the recommended sound model, to obtain a synthesized voice file.

Figure 7:
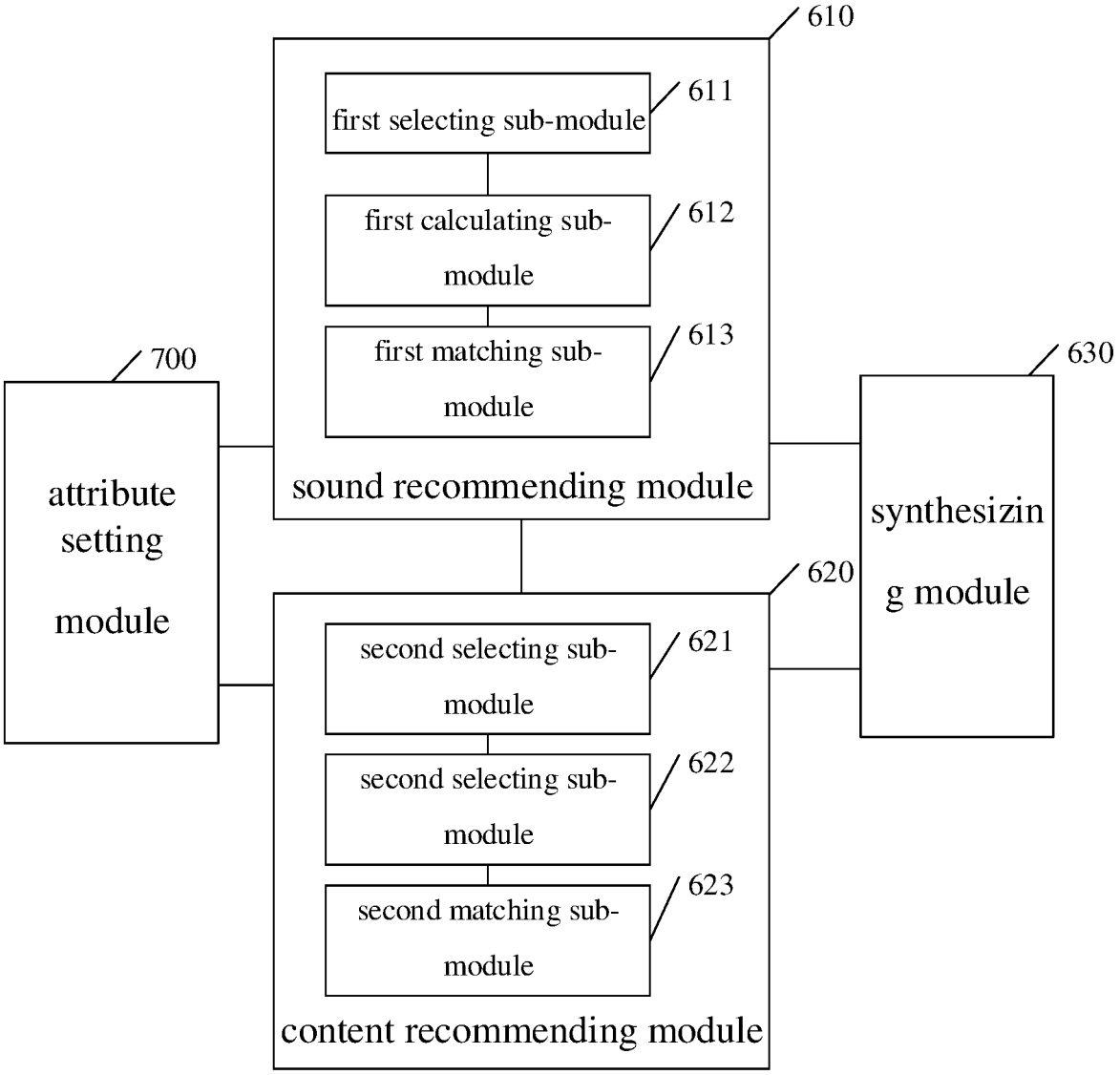
FIG. 7 is a schematic structural diagram of another voice synthesis device, according to an embodiment.

FIG. 7 is a schematic structural diagram of another voice synthesis device, according to an embodiment, the device includes:

an attribute setting module 700 configured to set a user attribute for a user, respective sound model attributes for the plurality of sound models, and respective content attributes for the plurality of contents; wherein the user attribute includes at least one user tag, and a weight for the user tag; each sound model attribute includes at least one sound model tag, and a weight for the sound model tag; and each content attribute includes at least one content tag, and a weight for the content tag.

The device further includes the sound recommending module 610, the content recommending module 620, and the synthesizing module 630. The foregoing three modules are the same as the corresponding modules in the foregoing embodiments, which are not described in detail again.

In a possible implementation, the sound recommending module 610 includes:

a first selecting sub-module 611 configured to select a sound model tag of the sound model attribute, according to a user tag of the user attribute;

a first calculating sub-module 612 configured to calculate a relevance degree between the user tag and the sound model tag, according to a weight of the user tag and a weight of the sound model tag; and a first matching sub-module 613 configured to determine the first matching degree between the user attribute and the sound model attribute, according to the relevance degree between the user tag and the sound model tag.

In a possible implementation, the content recommending module 620 includes:

a second selecting sub-module 621 configured to select a content tag of the content attribute, according to a sound model tag of the sound model attribute;

a second calculating sub-module 622 configured to calculate a relevance degree between the sound model tag and the content tag, according to a weight of the sound model tag and a weight of the content tag; and a second matching sub-module 623 configured to determine the second matching degree between the sound model attribute and the content attribute, according to the relevance degree between the sound model tag and the content tag.

For the functions of the respective modules in the device according to the embodiments of the present application, it is possible to refer to the corresponding description in the foregoing methods, which are not described here in detail again.

Figure 8:
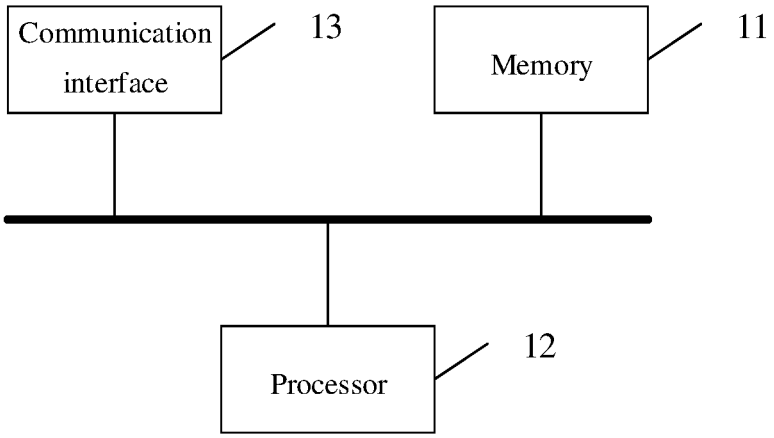
FIG. 8 is a schematic structural diagram of a voice synthesis apparatus, according to an embodiment.

In embodiments, a voice synthesis apparatus is further provided. FIG. 8 is a schematic structural diagram of a voice synthesis apparatus, according to an embodiment. The apparatus includes:

a memory 11 and a processor 12. The memory 11 stores a computer program executable on the processor 12. The voice synthesis method in the above embodiments is implemented when the processor 12 executes the computer program. The number of either the memory 11 or the processor 12 may be one or more.

The apparatus may further include:

a communication interface 13, configured to communicate with an external device to perform data interaction and transmission.

The memory 11 may include a high-speed RAM memory, or may also include a non-volatile memory, such as at least one disk memory.

If the memory 11, the processor 12 and the communication interface 13 are implemented independently, the memory 11, the processor 12 and the communication interface 13 may be connected to one another via a bus so as to realize mutual communication. The bus may be an industry standard architecture (ISA) bus, a peripheral component interconnect (PCI) bus, an extended industry standard architecture (EISA) bus, or the like. The bus may be categorized into an address bus, a data bus, a control bus and so on. For ease of illustration, only one bold line is shown in FIG. 8 to represent the bus, but it does not mean that there is only one bus or only one type of bus.

Optionally, in a specific implementation, if the memory 11, the processor 12 and the communication interface 13 are integrated on one chip, then the memory 11, the processor 12 and the communication interface 13 can complete mutual communication through an internal interface.

In the present specification, the description referring to the terms "one embodiment", "some embodiments", "an example", "a specific example", or "some examples" or the like means that the specific features, structures, materials, or characteristics described in connection with the embodiment or example are contained in at least one embodiment or example of the present application. Moreover, the specific features, structures, materials, or characteristics described may be combined in a suitable manner in any one or more embodiments or examples. In addition, various embodiments or examples described in the specification and features of different embodiments or examples may be incorporated and combined by those skilled in the art without mutual contradiction.

In addition, the terms "first" and "second" are used for descriptive purposes only and are not to be construed as indicating or implying relative importance or implicitly indicating the number of indicated technical features. Thus, features defining "first" and "second" may explicitly or implicitly include at least one of the features. In the description of the present application, "a plurality of" means two or more, unless expressly limited otherwise.

Any process or method descriptions described in flowcharts or otherwise herein may be understood as representing modules, segments or portions of code that include one or more executable instructions for implementing the steps of a particular logical function or process. The scope of the preferred embodiments of the present application includes additional implementations in which functions are not performed in the order shown or discussed, including according to the functions involved, in substantially simultaneous or in reverse order, which should be understood by those skilled in the art to which the embodiment of the present application belongs.

Logics and/or steps, which are represented in the flowcharts or otherwise described herein, for example, may be thought of as a sequencing listing of executable instructions for implementing logical functions, which can be specifically embodied in any computer-readable medium, for use by or in connection with an instruction execution system, device or apparatus (such as a computer-based system, a processor-included system, or another system that fetch instructions from an instruction execution system, device or apparatus and execute the instructions). For the purposes of this specification, a "computer-readable medium" can be any device that can contain, store, communicate, propagate or transmit programs for use by or in connection with the instruction execution system, device or apparatus. The computer-readable medium described in the specification may be a computer-readable signal medium or a computer-readable storage medium or any combination of a computer-readable signal medium and a computer-readable storage medium. More specific examples (a non-exhaustive list) of computer-readable medium include the following: electrical connections (electronic devices) having one or more wires, a portable computer disk cartridge (magnetic device), random access memory (RAM), read only memory (ROM), erasable programmable read-only memory (EPROM or flash memory), optic fiber devices, and portable read only memory (CDROM). In addition, the computer-readable storage medium may even be paper or other suitable medium upon which the program can be printed, as it can be read, for example, by optical scanning of the paper or other medium, followed by editing, interpretation or, where appropriate, process otherwise to electronically obtain the program, which is then stored in a computer memory.

It should be understood that various portions of the present application may be implemented by hardware, software, firmware, or a combination thereof. In the above embodiments, multiple steps or methods may be implemented in firmware or software stored in a memory and executed by a suitable instruction execution system. For example, if implemented in hardware, as in another embodiment, they can be implemented using any one or a combination of the following techniques well known in the art: discrete logic circuits having a logic gate circuit for implementing logic functions on data signals, application specific integrated circuits with suitable combinational logic gate circuits, programmable gate arrays (PGA), field programmable gate arrays (FPGAs), and the like.

Those skilled in the art may understand that all or some of the steps carried in the methods in the foregoing embodiments may be implemented by a program instructing relevant hardware. The program may be stored in a computer-readable storage medium, and when executed, one of the steps in the method embodiment or a combination thereof is included.

In addition, each of the functional units in the embodiments of the present application may be integrated in one processing module, or each of the units may exist alone physically, or two or more units may be integrated in one module. The above-mentioned integrated module can be implemented in the form of hardware or in the form of a software functional module. When the integrated module is implemented in the form of a software functional module and is sold or used as an independent product, the integrated module may also be stored in a computer-readable storage medium. The storage medium may be a read only memory, a magnetic disk, an optical disk, or the like.

In summary, by applying the voice synthesis method and apparatus according to the embodiments of the present application, a suitable sound model is recommended for a user by performing a matching operation on a user attribute and a sound model attribute of each sound model. After the recommended sound model is determined, suitable content is then recommended for the user by performing a matching operation on a sound model attribute and a content attribute of each content respectively. Thereafter, a voice synthesis on the recommended content is performed by using the recommended sound model. Since the recommended content is determined based on the recommended sound model, it is possible to select content suitable for the timbre characteristics of the recommended sound model, so that the synthesized voice file can better exert the advantages of each sound model, thereby improving the user experience.

The foregoing descriptions are merely specific embodiments of the present application, but not intended to limit the protection scope of the present application. Those skilled in the art can easily conceive of various changes or modifications within the technical scope disclosed herein, all these should be covered by the protection scope of the present application. Therefore, the protection scope of the present application should be subject to the protection scope of the claims.

What is claimed is:

1. A voice synthesis method, comprising:

for each sound model of a plurality of sound models, performing a first matching operation on a user attribute and a sound model attribute of the sound model to obtain a first matching degree for the sound model attribute, and determining a sound model with a sound model attribute having the highest first matching degree as a recommended sound model;

for each content of a plurality of contents, performing a second matching operation on a sound model attribute of the recommended sound model and a content attribute of the content to obtain a second matching degree for the content attribute, and determining a content with a content attribute having the highest second matching degree as a recommended content; and performing a voice synthesis on the recommended content by using the recommended sound model, to obtain a synthesized voice file.

2. The voice synthesis method according to claim 1, wherein prior to the performing the first matching operation, the method further comprises:

setting a user attribute for a user, respective sound model attributes for the plurality of sound models, and respective content attributes for the plurality of contents; wherein the user attribute comprises at least one user tag, and a weight for the user tag;

each sound model attribute comprises at least one sound model tag, and a weight for the sound model tag; and each content attribute comprises at least one content tag, and a weight for the content tag.

3. The voice synthesis method according to claim 2, wherein the first matching operation comprises:

selecting a sound model tag of the sound model attribute, according to a user tag of the user attribute;

calculating a relevance degree between the user tag and the sound model tag, according to a weight of the user tag and a weight of the sound model tag; and determining the first matching degree between the user attribute and the sound model attribute, according to the relevance degree between the user tag and the sound model tag.

4. The voice synthesis method according to claim 2, wherein the second matching operation comprises:

selecting a content tag of the content attribute, according to a sound model tag of the sound model attribute;

calculating a relevance degree between the sound model tag and the content tag, according to a weight of the sound model tag and a weight of the content tag; and determining the second matching degree between the sound model attribute and the content attribute, according to the relevance degree between the sound model tag and the content tag.

5. A voice synthesis device, comprising:

one or more processors; and a storage device configured for storing one or more programs, wherein the one or more programs are executed by the one or more processors to enable the one or more processors to:

for each sound model of a plurality of sound models, perform a first matching operation on a user attribute and a sound model attribute of the sound model to obtain a first matching degree for the sound model attribute, and determine a sound model with a sound model attribute having the highest first matching degree as a recommended sound model;

for each content of a plurality of contents, perform a second matching operation on a sound model attribute of the recommended sound model and a content attribute of the content to obtain a second matching degree for the content attribute, and determine a content with a content attribute having the highest second matching degree as a recommended content; and perform a voice synthesis on the recommended content by using the recommended sound model, to obtain a synthesized voice file.

6. The voice synthesis device according to claim 5, wherein the one or more programs are executed by the one or more processors to enable the one or more processors to:

set a user attribute for a user, respective sound model attributes for the plurality of sound models, and respective content attributes for the plurality of contents; wherein the user attribute comprises at least one user tag, and a weight for the user tag;

each sound model attribute comprises at least one sound model tag, and a weight for the sound model tag; and each content attribute comprises at least one content tag, and a weight for the content tag.

7. The voice synthesis device according to claim 6, wherein the one or more programs are executed by the one or more processors to enable the one or more processors to:

select a sound model tag of the sound model attribute, according to a user tag of the user attribute;

calculate a relevance degree between the user tag and the sound model tag, according to a weight of the user tag and a weight of the sound model tag; and determine the first matching degree between the user attribute and the sound model attribute, according to the relevance degree between the user tag and the sound model tag.

8. The voice synthesis device according to claim 6, wherein the one or more programs are executed by the one or more processors to enable the one or more processors to:

select a content tag of the content attribute, according to a sound model tag of the sound model attribute;

calculate a relevance degree between the sound model tag and the content tag, according to a weight of the sound model tag and a weight of the content tag; and determine the second matching degree between the sound model attribute and the content attribute, according to the relevance degree between the sound model tag and the content tag.

9. A non-volatile computer-readable storage medium having computer programs stored thereon, wherein the computer programs, when executed by a processor, cause the processor to implement the method of claim 1.

* * * * *